United States Patent [19]

Fujikawa

[11] Patent Number: 4,648,339

[45] Date of Patent: Mar. 10, 1987

[54] SPEED CONTROL APPARATUS FOR SEWING MACHINE

[75] Inventor: Katsuhiro Fujikawa, Aichi, Japan

[73] Assignee: Mitsubishi Denki Kabushiki Kaisha, Tokyo, Japan

[21] Appl. No.: 739,259

[22] Filed: May 30, 1985

[30] Foreign Application Priority Data

May 30, 1984 [JP] Japan ..... 59-108485

[51] Int. Cl.[4] ..... D05B 69/18

[52] U.S. Cl. ..... 112/277

[58] Field of Search ..... 112/277, 275, 220, 121.11; 318/467, 369

[56] References Cited

U.S. PATENT DOCUMENTS 3,761,790 9/1973 Daab ..... 112/275 X 4,080,914 3/1978 Ishida et al. ..... 112/277

4,195,585 4/1980 Takahashi et al. ..... 112/277

4,473,020 9/1984 Neki et al. ..... 112/277

*Primary Examiner*—Peter Nerbun

*Attorney, Agent, or Firm*—Sughrue, Mion, Zinn, Macpeak, and Seas

[57] ABSTRACT

A sewing machine speed control apparatus enabling finer control of sewing machine rotational speed by providing speed instructive pulses to a clutch coil and a braking coil of the sewing machine within a pulse application period of an oscillator used to detect the actual rotational speed of the sewing machine. The speed instructive pulses are applied in accordance with a difference between actual and desired speeds; the difference is used to look up stored values corresponding to desired periods of application of speed instructive pulses.

10 Claims, 5 Drawing Figures

| (Sa) | $T_n$ | $T_n'$ | $T_n''$ |
|---|---|---|---|
| 1 | $T_1$ | $T_1'$ | $T_1''$ |
| 2 | $T_2$ | $T_2'$ | $T_2''$ |
| 3 | $T_3$ | $T_3'$ | $T_3''$ |
| 4 | $T_4$ | $T_4'$ | $T_4''$ |
| 5 | $T_5$ | $T_5'$ | $T_5''$ |
| OVER 6 | $T_6$ | $T_6'$ | $T_6''$ |

LOOK-UP TABLE

SPEED CONTROL APPARATUS FOR SEWING MACHINE

BACKGROUND OF THE INVENTION

The present invention relates to an apparatus for controlling the speed of sewing by applying a speed instructive pulse signal to the sewing machine's driving and braking mechanism.

Conventional sewing machine speed control apparatuses have been provided with a speed detector, a counter for counting the number of pulses generated by the speed detector at an interval proportional to the sewing machine's rotational speed, a control circuit for producing a speed instructive pulse signal to a driving means (such as a clutch motor) or a braking means (such as an electromagnetic brake) of the sewing machine in accordance with the pulse count, an oscillator for setting the timing for applying the pulse count to the control circuit, and a speed setting circuit for setting the rotational speed of the sewing machine, and for outputting the set speed to the control circuit. Sewing machine speed was controlled so that, at the same time that an oscillator pulse was applied to the control circuit, the counter content was applied to the control circuit. The control circuit would compare the counter content with the instruction from the speed setting circuit and provide an instruction to the driving means or the braking means.

However, in the conventional sewing machine speed control apparatus, it was impossible to control the driving means and the braking means more finely than the interval of pulses of the oscillator would permit, because the application of the output of the counter to the control circuit was controlled by the synchronization provided by the oscillator. As a result, even when the difference between the speed set by the speed setting circuit and the actual running speed was very small, the content of the counter was not entered into the control circuit during the oscillation period of the pulse, so that the previously set speed was continuously applied until the next pulse was produced, so that ripples in the speed became large.

SUMMARY OF THE INVENTION

Accordingly, an object of the present invention is therefore to eliminate this defect.

Another object of the present invention is to provide an improved sewing machine speed control apparatus in which the width of a speed instructive pulse for the driving means or braking means may be varied in order to provide finer, more accurate control.

To attain the above-mentioned objects, the inventive sewing machine speed control apparatus comprises a speed detecting means for detecting a rotational speed of a sewing machine, a speed setting means for setting a desired rotational speed of the sewing machine, and a control circuit responsive to respective output signals of the speed detecting means and the speed setting means for producing a speed instructive pulse signal to a driving means and a braking means of the sewing machine, the control circuit being arranged such that, every speed control period, the pulse width of the speed instructive pulse signal is varied in accordance with the difference between the actual rotational speed and the desired setting speed of the sewing machine.

BRIEF DESCRIPTION OF THE DRAWINGS

Other features and advantages of the invention will be apparent from the following description taken in conjunction with accompanying drawings, in which.

DETAILED DESCRIPTION OF A PREFERRED EMBODIMENT

Figure 1:
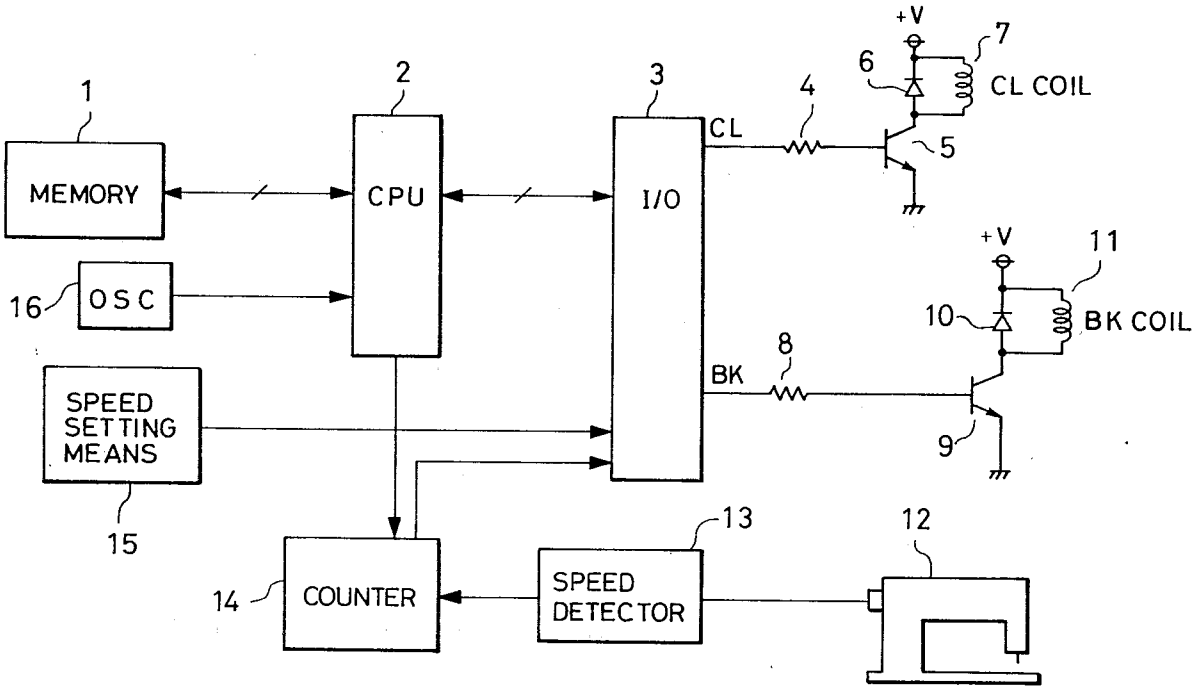
FIG. 1 is a block diagram of the sewing machine speed control apparatus according to the present invention.

Referring to the drawings, a preferred embodiment of the present invention now will be described.

In FIG. 1, a memory 1 storing a program or the like is connected to a microprocessor (CPU) 2 for executing a control operation in accordance with the program stored in the memory. A programmable input/output (I/O) port 3 is connected to the CPU 2, and transistors 5 and 9 are connected at their respective bases to the I/O port 3 through resistors 4 and 8, respectively, so that the operation of transistors 5 and 9 is controlled by the I/O port 3. The respective collectors of the transistors 5 and 9 are connected to a power source through diodes 6 and 10 for protecting emitters of the transistors are grounded. An exciting (CL) coil 7 of a driving means, such as clutch motor, is connected across the diode 6 so that, when the CL coil 7 is excited, the driving means drives a sewing machine 12, as will be described later. Another exciting (BK) coil 11 of a braking means, such as an electromagnetic brake, is connected across the diode 10 so that when the BK coil is excited, braking force is applied to the sewing machine 12.

A sewing machine 12 is connected to an input of a speed detector 13, and transmits pulses representing sewing machine speed. The output of the speed detector passes to an input of a counter 14 for counting the number of pulses. The output of the counter 14 passes to the I/O port 3. A speed setting means 15 and an oscillator 16 are connected to the I/O port 3 and the CPU 2, respectively.

The operation of the inventive speed detector now will be described, for the case in which a high speed is set by the speed setting means 15. The CPU 2 receives the number of pulses detected by speed detector 13 and counted by the counter 14, through the I/O port 3. (Every revolution of the sewing machine apparatus produces a number of pulses.) The CPU 2 receives the pulse count at a predetermined interval, as defined by the oscillator 16, in the following manner. When the oscillator 16 applies a pulse, the counter contents received by the CPU 2 are processed according to the flowchart shown in FIG. 2. The memory 1 contains a table of time intervals for producing a speed setting pulse, as shown in FIG. 3, as well as a program, according to the flowchart of FIG. 2.

Figure 2:
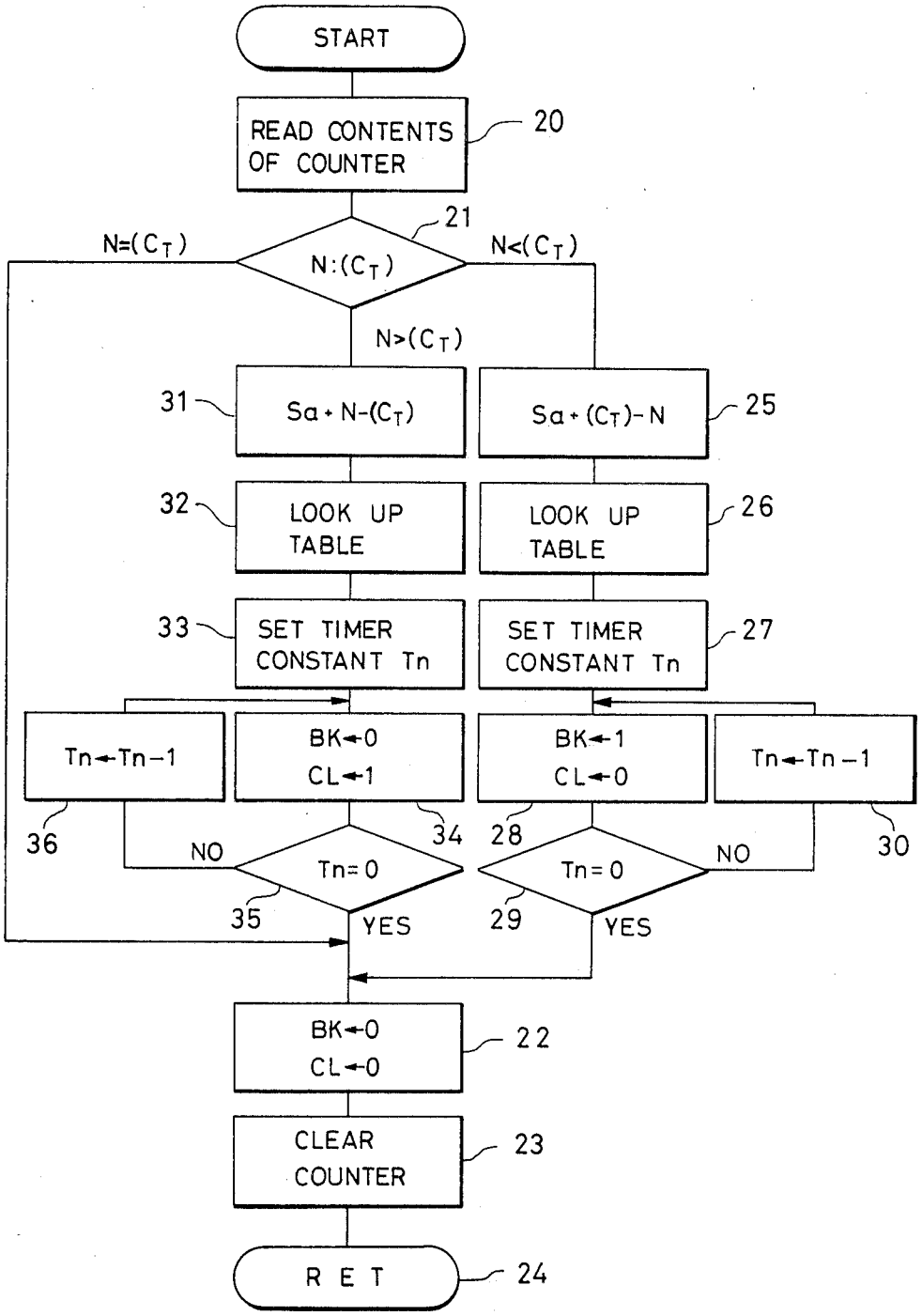
FIG. 2 is a flowchart showing the control procedure of the apparatus of FIG. 1.

As an example, the value N corresponding to the speed is 8. The counter contents are read into the CPU 2 through the I/O port 3 (step 20), and the BK coil 11 and the CL coil 7 are controlled in accordance with the flowchart of FIG. 2 based on the received counter content CT and the value of N (8). As shown in FIG. 2, the CPU compares N. and CT, and if they are different, the period of time for exciting the BK coil 11 and CL coil 7 is varied in accordance with the difference.

Figures 3, 4:
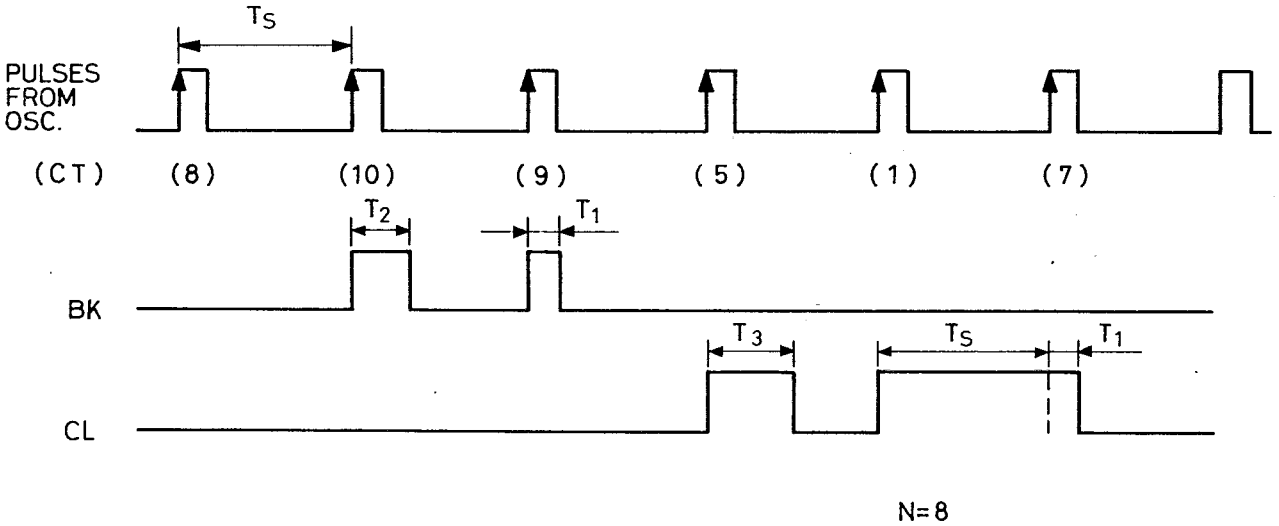
FIG. 3 is a explanatory diagram showing an exemplary arrangement of a table provided in a memory of the apparatus of FIG. 1 for producing a speed instructive pulse.
FIG. 4 is a time chart showing the temporal relation of the control pulses to the oscillator pulse in the apparatus of FIG. 1.

Referring to FIGS. 2, 3, and 4, specific control processing for varying the exciting time will be described. When the CT is 8, N=CT, so that "0" is stored in each of BK and CL (step 22), and the counter is cleared (step 23) and reset (step 24). Thus, neither the BK coil nor the CL coil is excited, and the output is not varied in a period Ts of the oscillator 16, that is, in one speed control period.

If CT of the counter 14 is 10 when a next pulse is received, CT>N, so that "1" and "0" are set in BK and CL respectively, whereby the BK coil is excited. At the same time, the difference between N and CT is calculated and stored in Sa (step 25). The CPU 3 looks up the table of FIG. 3 (step 26) using the value of Sa as a key (step 26) and sets a timer constant T2, since CT−N=2 (step 27). The above condition is maintained for this period T2 (steps 28 to 30). Thereafter "0" is stored in each of BK and CL (step 22), so that the BK coil is no longer excited. Accordingly, the BK coil 11 is excited only for a period T2.

If CT is 9 when the next pulse is produced, Sa becomes 1 so that T1 is set as the result of looking up in the table and "1" and "0" are set in BK and CL respectively for a period T1. Thus, the BK coil 11 is excited only for the time of T1.

If CT is 5, N is larger than CT, so that "0" and "1" are stored in BK and CL, respectively, 3 is set in Sa (step 31), and the CPU 2 looks up in the table (step 32) to thereby set a period T3 (step 33) for exciting the CL coil. Then, "0" is stored in each of BK and CL when the period T3 has elapsed, so that the CL coil is no longer excited.

Speed control generally continues to be performed as described above. However, when Sa is equal to or larger than 6, the BK coil 11 or the CL coil 7 is excited for one speed control period, that is the oscillation period Ts of the oscillator 6. When the speed set by speed setting means 15 varies, different tables for the time Tn', Tn'', etc., corresponding to the various values of N, may be used.

Figure 5:
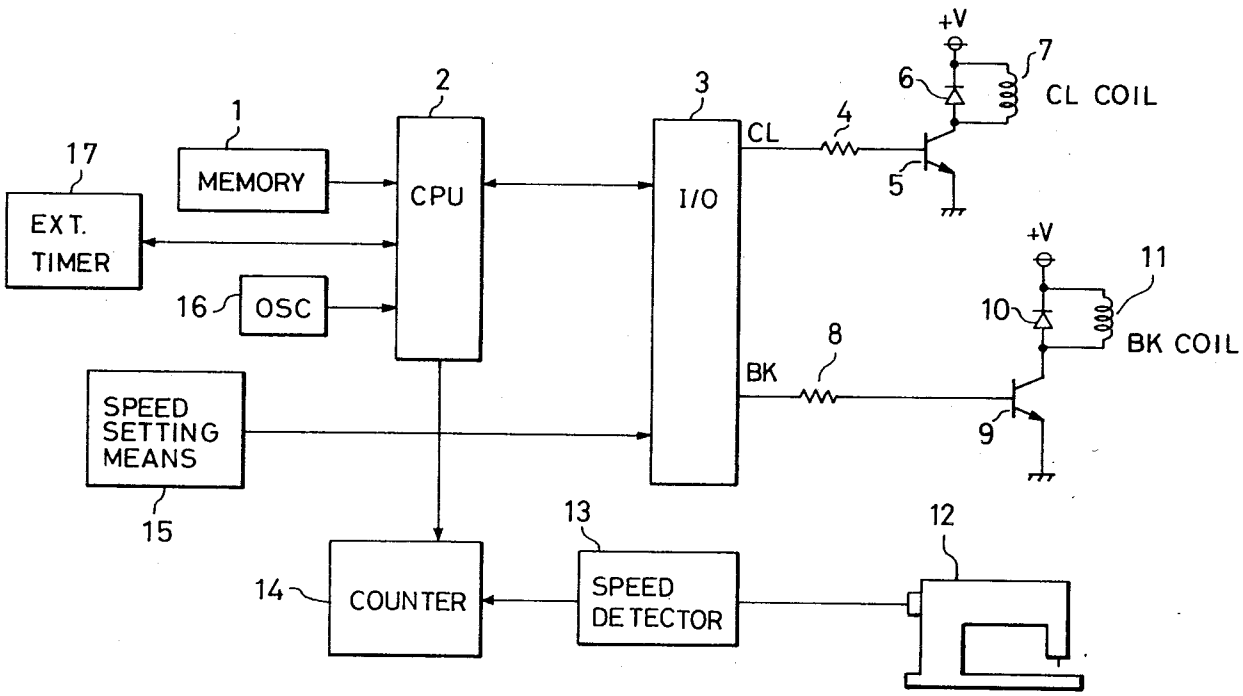
FIG. 5 is a block diagram of an alternative embodiment of the invention.

Although a program controlled timer using table look up is used for providing the time Tn in the above-described embodiment, an external timer circuit 17, as shown in FIG. 5, may be used. Further, although speed is varied by changing the value of N in the aforegoing embodiment, the same effect can be obtained by changing the frequency of the oscillator 16 in accordance with the change in speed set by the speed setting means 15.

To summarize, in the present invention, a function of pulse width modulation is introduced for the sewing machine speed control so as to change the pulse width in accordance with a difference between an actual rotational speed and a desired speed of the sewing machine, enabling highly accurate speed control.

I claim:

1. A sewing machine speed control apparatus comprising:

a driving means for driving said sewing machine;

braking means for braking the rotating movement of said sewing machine;

speed detecting means for detecting a rotating speed of said sewing machine and outputting a speed detection signal accordingly;

speed setting means for outputting a speed setting signal to set a rotational speed of said sewing machine; and control circuit means, responsive to said speed detection signal and said speed setting signal, for outputting a speed instructive pulse signal to said driving means and said braking means;

said control circuit means including oscillator means, having an oscillating period, for generating a pulse for determining a duration of one speed control period, and a counter for counting pulses corresponding to said speed detection signal in every said one speed control period determined by said oscillator means, means for calculating a difference between an actual speed detected by said speed detection means and a setting speed set by said speed setting means during said one speed control period, and means for changing the pulse width of said speed instructive pulse signal within said one speed control period in accordance with said difference, the pulse width of the speed instructive pulse signal being changed in accordance with a difference between the count of said counter and said setting speed.

2. A sewing machine speed control apparatus according to claim 1, wherein said control circuit means further includes a memory means for storing various values corresponding to the pulse width of said speed instructive pulse signal and means responsive to the difference between the actual speed and the setting speed for selecting a corresponding one of said values.

3. A sewing machine speed control apparatus according to claim 1, in which said driving means comprises an electric motor provided with an electromagnetic clutch having a clutch coil whose excitation is controlled by the speed instructive pulse signal.

4. A sewing machine speed control apparatus according to claim 1, in which said driving means comprises an electric motor provided with an electromagnetic brake having a brake coil whose excitation is controlled by the speed instructive pulse signal.

5. A sewing machine speed control apparatus according to claim 3, wherein said clutch coil is excited when said setting speed is greater than said actual speed, a period of excitation of said clutch coil being no greater than said speed control period.

6. A sewing machine speed control apparatus according to claim 4, wherein said brake coil is excited when said actual speed is greater than said setting speed, a period of excitation of said brake coil being no greater than said speed control period.

7. A sewing machine speed control apparatus according to claim 2, wherein said calculating means comprises a CPU, and wherein said control circuit further comprises an input/output port for applying said speed instructive pulse signal.

8. A sewing machine speed control apparatus according to claim 1, wherein said means for changing the pulse width of said speed instructive signal comprises an external timer.

9. A sewing machine speed control apparatus according to claim 1, wherein the oscillting period of said oscillating means is varied according to a change in said setting speed.

10. A sewing machine speed control apparatus according to claim 2, wherein said memory means further includes a stored program, and said control circuit means further comprises a CPU which includes said difference calculating means and said pulse width changing means, said CPU performing the following steps during each said speed control period in accordance with said stored program:

comparing said actual speed with said setting speed; and if said actual speed is substantially the same as said setting speed, outputting said speed instructive pulse signal to said driving means and said braking means whereby said driving means and said braking means are inoperative during said speed control period;

if said actual speed is greater than said setting speed, subtracting a first value substantially corresponding to said setting speed from a second value substantially corresponding to said actual speed, to obtain a first difference; selecting one of said various values in accordance with said first difference; changing the pulse width of said speed instructive pulse signal in accordance with the selected value; and outputting said speed instructive pulse signal to said driving means and said braking means, whereby said driving means is inoperative during said speed control period, and said braking means is operative for a period of time substantially corresponding to the pulse width of said speed instructive pulse signal;

if said actual speed is less than said setting speed, subtracting said second value from said first value to obtain a second difference; selecting one of said various values in accordance with said second difference; changing the pulse width of said speed instructive pulse signal in accordance with the selected value; and outputting said speed instructive pulse signal to said driving means and said braking means, whereby said driving means is operative for a period of time substantially corresponding to the pulse width of said speed instructive pulse signal, and said braking means is inoperative during said speed control period.

* * * * *